US006128921A

United States Patent [19]

Guillard et al.

[11] Patent Number: 6,128,921

[45] Date of Patent: Oct. 10, 2000

[54] AIR DISTILLATION PLANT COMPRISING A PLURALITY OF CRYOGENIC DISTILLATION UNITS OF THE SAME TYPE

[75] Inventors: Alain Guillard, Paris; Bernard Saulnier, Colombes, both of France

[73] Assignee: L'Air Liquide, Paris, France

[21] Appl. No.: 09/245,874

[22] Filed: Feb. 8, 1999

[30] Foreign Application Priority Data

Feb. 6, 1998 [FR] France ..... 98 01435

[51] Int. Cl.[7] ..... F25J 3/00

[52] U.S. Cl. ..... 62/643; 62/902; 62/911

[58] Field of Search ..... 62/643, 902, 911

[56] References Cited

U.S. PATENT DOCUMENTS 3,161,492 12/1964 Keith et al. ..... 62/911
5,349,827 9/1994 Bracque et al. ..... 62/298
5,412,954 5/1995 Grenier .
5,896,755 4/1999 Wong et al. ..... 62/643

FOREIGN PATENT DOCUMENTS 0 485 612 5/1992 European Pat. Off. .
0 756 144 1/1997 European Pat. Off. .

*Primary Examiner*—William Doerrler
*Attorney, Agent, or Firm*—Young & Thompson

[57] ABSTRACT

In this plant (1), a common thermal insulation wall (14) surrounds first and second distillation units (2, 3, 4, 5). A first product stream is removed from the first unit and a second stream is removed from the second unit, the first and second streams are mixed without having previously been compressed or expanded with the production of external work.

37 Claims, 3 Drawing Sheets

AIR DISTILLATION PLANT COMPRISING A PLURALITY OF CRYOGENIC DISTILLATION UNITS OF THE SAME TYPE

FIELD OF THE INVENTION

The present invention relates to an air distillation plant comprising a plurality of cryogenic distillation units and means for thermally insulating these distillation units.

BACKGROUND OF THE INVENTION

The invention applies more particularly to the double-column distillation of large air throughputs.

The dimensions of double distillation columns, in particular their maximum diameters corresponding to their low-pressure columns, increase with the air throughputs which they are capable of distilling.

Above a certain air throughput, typically 600,000 $m^3$[stp]/h, the dimensions of a double column generally no longer allow it to be transported.

Two solutions have so far been adopted for constructing an air distillation plant capable of treating large air throughputs on an industrial site distant from the works of a company constructing the column.

The first solution consists in creating a column construction workshop on the industrial site in order to construct one double column with dimensions sufficient for treating the air throughputs in question.

Such a solution involves setting up elaborate temporary logistics, and is found to be particularly expensive.

The second solution consists in producing, in the workshop, a plurality of double distillation columns whose dimensions allow them to be transported, then transporting them to the industrial site where they are installed in parallel as a corresponding number of individual distillation units allowing the air throughputs in question to be treated separately.

Each double column installed on the site is thus connected to its own air purification device, its own heat-exchange line, and is surrounded by its own thermal insulation wall, thus forming as many cold boxes as there are double columns. Such a solution is also expensive.

GB-A-1216192 describes a system for distilling air to produce separate streams of oxygen at two different purities using a medium pressure column to produce reflux streams for two low pressure columns. The medium pressure column is thermally linked with one of the low pressure columns via a reboiler-condenser; this column is additionally fed by expanded air.

SUMMARY OF THE INVENTION

The object of the invention is to provide an air distillation plant comprising a plurality of cryogenic distillation units of the same type, having a lower construction cost.

To this end, the invention relates to an air distillation plant comprising a plurality of cryogenic distillation units, and means for thermally insulating these distillation units, a feed air conduit for supplying air to at least one distillation unit, the thermal insulation means comprising a common thermal insulation wall surrounding at least first and second distillation units, first and second conduits for removing a product stream from the first and second distillation units respectively and means for forming a single product stream from the streams in the first and second conduits characterized in that there are no expansion means producing external work or compressors provided in the first or second conduit.

According to particular embodiments of the invention, the plant may comprise one or more of the following characteristics, taken separately or in any technically feasible combination:

- the distillation units being connected to at least one air feed conduit via means for pre-treating the air to be distilled, these pre-treatment means comprise at least one common pre-treatment unit to which at least two of the distillation units are connected in parallel
- at least one common pre-treatment unit is an air purification device
- at least one common pre-treatment unit is a heat-exchange line for cooling the air to be distilled
- distillation units each being connected to at least one heat exchanger body, these heat exchanger bodies are surrounded by a common thermal insulation wall
- the first distillation units comprise double distillation columns, each having a medium-pressure column, a low-pressure column and a vaporiser/condenser providing a heat-exchange link between these two columns
  - the first distillation units comprise low-pressure columns, and the plant also comprises at least one medium-pressure column equipped with a head vaporiser/condenser, which are also surrounded by the common thermal insulation wall,
  - the medium-pressure column is connected to the air feed conduit and the low-pressure columns is connected in parallel to the vaporiser/condenser
- the plant also comprises means for storing at least one liquid fraction produced by a cryogenic distillation unit surrounded by the thermal insulation wall, the storage means are also surrounded by the common thermal insulation wall
- the storage means comprise at least one common reservoir for storing a liquid fraction produced by the first distillation units, to which reservoir at least two of the first cryogenic distillation units are connected in parallel
- at least two of the first distillation units have different capacities
- at least two of the first distillation units are columns provided with internal packing and/or liquid distributors of different structures and/or densities.
- the first units comprise at least two medium-pressure columns, two low-pressure columns and two vaporiser/condensers which each provide a heat-exchange link between a medium-pressure column and a low-pressure column, and the vaporiser/condensers are of different structures
  - at least two of the first distillation units are arranged beside one another
  - an expansion valve is provided in one of the first and second conduits
- the points of withdrawal of the streams in the first and second conduits are where the streams have the same principal component and such that the difference in the percentage represented by the principal component in the two streams does not exceed 2% or preferably 1%, still more preferably 0,5%
- the first and second units are argon columns fed by an argon containing stream removed from a double column
- the first and second units are fed only by streams which are fed to both units
- the first and second units are fed only by streams having the same principal component and containing substantially the same percentage of that component (i.e. with a maximum difference of 2%).

BRIEF DESCRIPTION OF THE DRAWINGS

The invention will be understood more clearly on reading the following description, which is provided solely by way of example and is given with reference to the appended drawings, in which.

DESCRIPTION OF THE PREFERRED EMBODIMENTS

Figure 1:
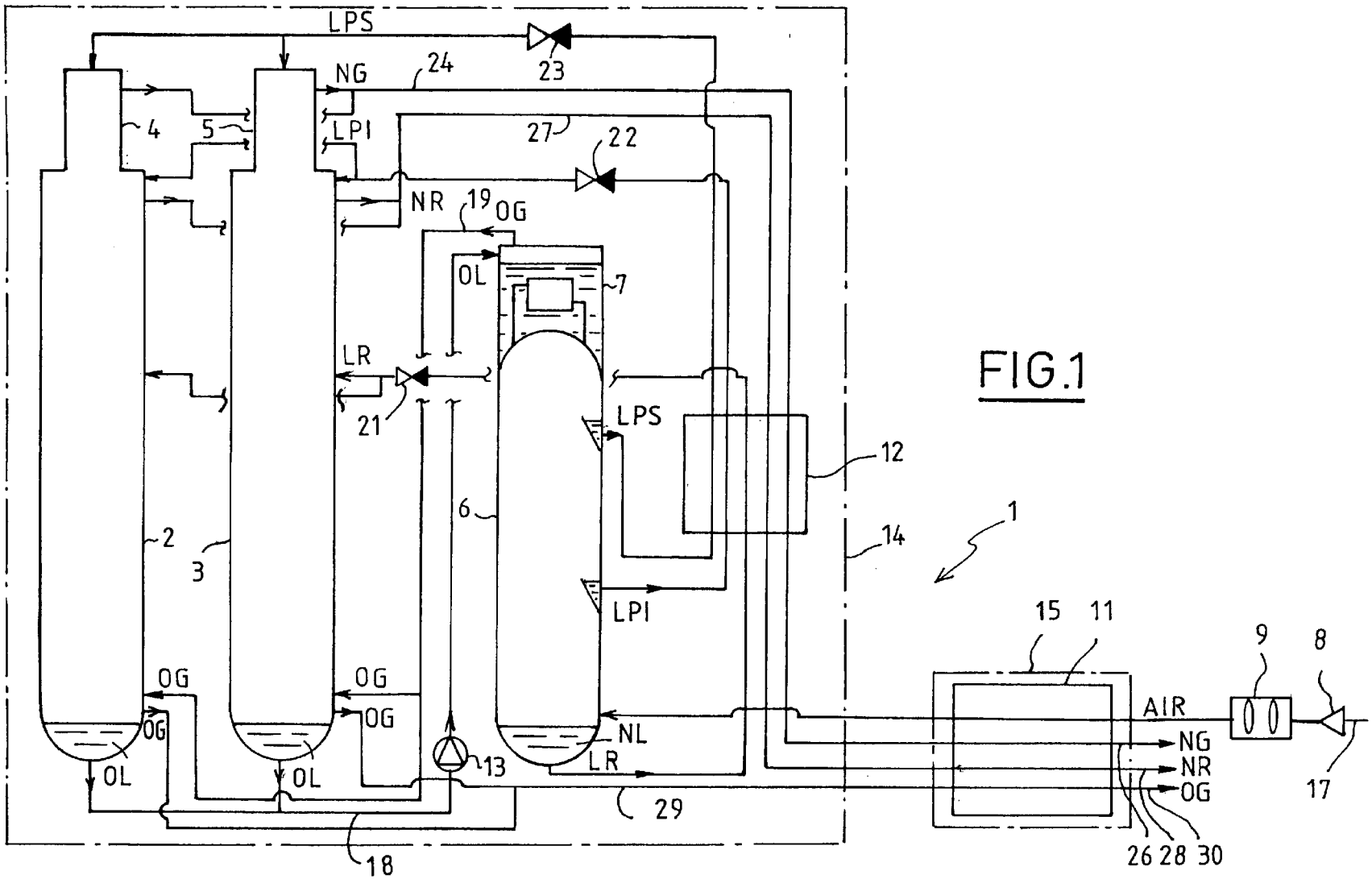
FIG. 1 is a schematic elevation view of a first embodiment of an air distillation plant according to the invention.

FIG. 1 represents an air distillation plant 1 comprising two cryogenic distillation units which are of the same type, that is to say which fulfil the same function in the distillation process implemented by the plant 1, as will become more clearly apparent in the following description.

These first and second units of the same type are identical and each comprise a low-pressure column 2, 3, equipped with a low-pressure pure nitrogen column or "minaret 4, 5 of small diameter, which lies above the column 2, 3 and whose base communicates directly with the top of the latter. These columns 2 to 5 are designed so that they can each take part in the distillation of an air throughput equal to about 400,000 $m^3$[stp]/h each. The diameters of the columns 2 and 3 are about 6 m.

Plant 1 furthermore essentially comprises a medium-pressure cryogenic distillation column 6, a vaporiser/condenser 7 which lies above the latter, an air compressor 8, a device 9 for purifying air by absorption, a main heat-exchange line 11, an auxiliary heat-exchange line or "super-cooler" 12, a pump 13, a main thermal insulation wall 14 and an auxiliary thermal insulation wall 15. The columns are all of the type with structured packing of the cross-corrugated variety.

The column 6 is designed so that it can take part in the distillation of an air throughput equal to twice that corresponding to each column 2 and 3, that is to say about 800,000 $m^3$[stp]/h. Its diameter is about 7 m.

The columns 2 and 3, on top of which the minarets 4 and 5 lie, are arranged vertically beside one another.

The thermal insulation wall 14 defines a single volume which surrounds the two low-pressure columns 2 and 3, the "minarets" 4 and 5, the medium-pressure column 6 and the heat-exchange line 12.

The heat-exchange line 11 is surrounded by the thermal insulation wall 15. The thermal insulation walls 14 and 15 each define one cold box.

The gaseous air to be distilled, delivered by a conduit 17, is compressed to a medium pressure by the compressor 8, then purified in the device 9, and finally cooled on passing the exchange line 11 before being introduced, close to its dew point, at the face of the medium-pressure column 6.

Liquid oxygen LO, taken from the base of each of the low-pressure columns 2 and 3 then collected by a common conduit 18, is delivered using the pump 13 fitted in this conduit to the vaporiser/condenser 7.

The vaporiser/condenser 7 vaporises this liquid oxygen by condensing nitrogen from the head of the medium-pressure column 6. This vaporised oxygen is then drawn off via a conduit 19 then divided into two flows, each sent to the base of one of the low-pressure columns 2 and 3.

"Rich liquid" RL (oxygen-enriched air) drawn off from the base of the medium-pressure column 6 is supercooled on passing through the auxiliary exchange line 12, then has its pressure reduced in a pressure-reduction valve 21, and is finally divided into two flows which are each injected at an intermediate level of one of the low-pressure columns 2 and 3.

"Lower lean liquid" LLL (impure nitrogen), drawn off from an intermediate point of the medium-pressure column 6, is supercooled on passing through the auxiliary change line 12, and has its pressure reduced in a pressure-reducing valve 22, and is finally divided into two flows which are each injected at the head of one of the low-pressure columns 2 and 3.

"Upper lean liquid" ULL (almost pure nitrogen), drawn off from the head of the medium-pressure column 6, is supercooled on passing through the auxiliary exchange line 12. This supercooled liquid then has its pressure reduced in a pressure-reducing valve 23 and is divided into two flows, which are each introduced at the top of one of the "minarets" 4 and 5.

Low-pressure nitrogen gas NG, drawn off from the head of each of the "minarets" 4 and 5 then collected via a conduit 24, passes through the auxiliary exchange line 12 where it is heated for a first time, by countercurrent indirect heat exchange with the liquids RL, LLL and ULL passing through this line 12. This nitrogen gas is then heated for a second time, on passing through the main heat-exchange line 11, by countercurrent indirect heat exchange with the air to be distilled which is passing through the line 11. This heated nitrogen gas is then distributed via a production conduit 26.

Impure nitrogen gas or "residual" nitrogen RN, taken from the top of each low-pressure column 2 and 3 and collected via a conduit 27, passes through the auxiliary exchange line 12 while being heated for a first time, by countercurrent indirect heat exchange with the liquids RL, LLL and ULL passing through this line 12. This impure nitrogen is then heated for a second time on passing through the main exchange line 11, by countercurrent indirect heat exchange with the air to be distilled which is passing through this line 11. This heated impure nitrogen is then distributed via a production conduit 28.

Oxygen gas streams OG having substantially the same purity, drawn off from the base of each first low-pressure column 2 and second low pressure column 3, via first and second conduits are mixed upstream of exchanger 11 without being expanded or compressed and are collected via a conduit 29 which conveys the mixture to the heat-exchange line 11, where this oxygen gas is heated by countercurrent indirect heat exchange with the air to be distilled which is flowing through this line 11. The heated oxygen gas is then distributed via a production conduit 30. It might be necessary to expand one of the oxygen streams in a valve if there is a small pressure difference.

The plant 1 in FIG. 1 allows a large air throughput of about 800,000 $m^3$[stp]/h to be distilled. Furthermore, the dimensions of the low-pressure columns 2 and 3 on top of which the minarets 4 and 5 lie, as well as the dimensions of the medium-pressure column 6, allow them to be manufactured in the workshop then transported to the industrial site of the plant 1.

Furthermore, the medium-pressure column 6, the main line 11, the compressor 8 and the air purification device 9 constitute air pre-treatment equipment common to the two low-pressure columns 2 to 5, by means of which these columns are connected in parallel to the air feed conduit 17.

The plant 1 in FIG. 1 has a relatively low construction cost by virtue of the common thermal insulation wall 14 and the common equipment 6, 8, 9 and 11.

In variants which have not been represented, the columns 2 and 3, and 4 and 5, respectively, have different capacities and/or are provided with internal packing and/or liquid distributors of different structures, in order to allow greater flexibility in terms of the production rates of the fluids.

The internal packing may thus, for example, be distillation plates and structured packing of the "cross-corrugated" variety.

In another variant which has not been represented, the main heat-exchange line 11 is contained in the thermal insulation wall 14, the thermal insulation wall 15 then being omitted.

Figure 2:
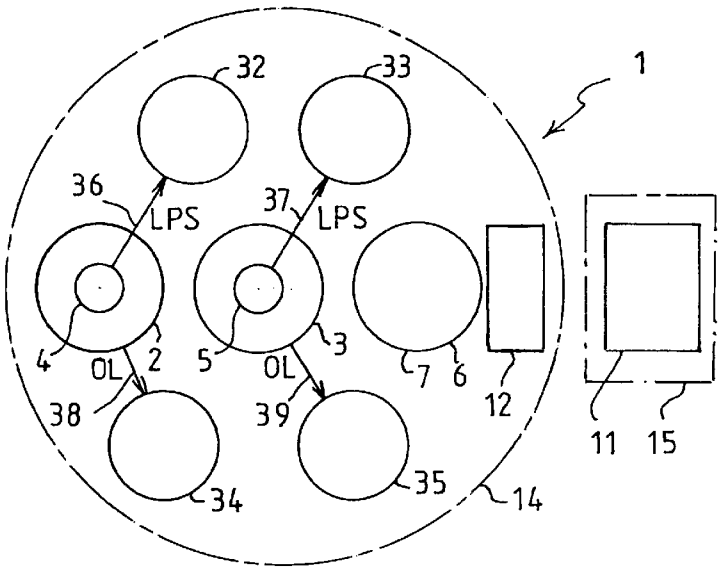
FIG. 2 is a schematic plan view of an alternative of the plant in FIG. 1.

FIG. 2 illustrates, schematically and in plan view, an alternative of the plant 1 in FIG. 1 which differs essentially from the latter by the presence of two reservoirs 32 and 33 for storing liquid nitrogen at low pressure, and two reservoirs 34 and 35 for storing liquid oxygen at low pressure.

Via a conduit 36, 37, each reservoir 32, 33 receives ULL liquid which is sent from the medium column 6 to the "minaret" 4, 5 and has its pressure reduced in the valve 23.

Via a conduit 38, 39, each reservoir 34, 35 receives liquid oxygen drawn off from the base of the low-pressure columns 2 and 3.

The wall 14 substantially has a cylindrical shape with a vertical axis and a circular base. The columns 2 to 5, the reservoirs 32 to 35, and the auxiliary heat-exchange line 12 are arranged compactly within this wall 14.

Figure 3:
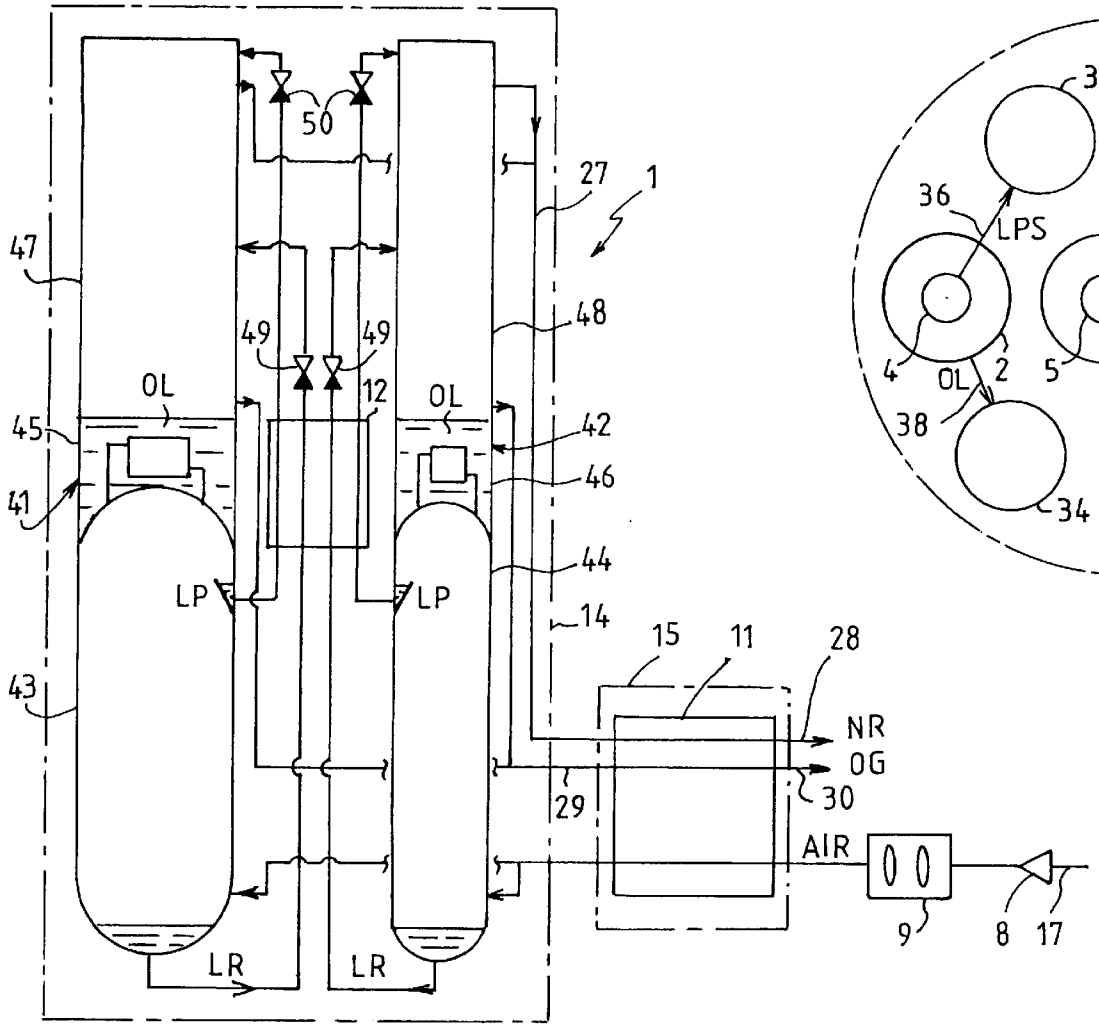
FIG. 3 is a similar view to FIG. 1, illustrating a second embodiment of an air distillation plant according to the invention.

FIG. 3 illustrates a second embodiment of an air distillation plant 1 according to the invention, in which the first and second units of the same type, which are surrounded by the common wall 14, are double columns of different capacities, namely a higher-capacity double column 41 which can distil an air throughput of about 600,000 $m^3$[stp]/h and has a maximum diameter of about 7 m, and a lower-capacity double column 42 which can distil an air throughput of about 400,000 $m^3$[stp]/h and a maximum diameter of about 6 m.

Each double column 41, 42 comprises a medium-pressure column 43, 44 on top of which a vaporiser/condenser 45, 46 lies, with a low-pressure column 47, 48 lying on top. The vaporiser/condenser 45, 46 is linked in terms of heat exchange with the medium-pressure column 43, 44 and the low-pressure column 47, 48.

In contrast to the plant 1 in FIG. 1, the low-pressure columns 47 and 48 do not have "minarets" lying on top, and the plant 1 does not have a pump 13.

The way in which the plant 1 in FIG. 3 functions differs as follows from the way in which the plant 1 in FIG. 1 functions.

The air cooled in the main exchange line 11 is divided into two flows which are each introduced at the base of one of the medium-pressure columns 43, 44. For each double column 41, 42, "rich liquid" RL drawn off from the base of the medium-pressure column 43, 44 is conveyed, after supercooling in the auxiliary exchange line 12 then pressure reduction in a pressure-reducing valve 49, to an intermediate point of the low-pressure column 45, 46.

For each double column 41, 42, "lean liquid" LL, drawn off from the head of the medium-pressure column 43, 44, is sent after supercooling on passing through the auxiliary exchange line 12 and pressure reduction in a pressure-reducing valve 50 to the head of the low-pressure column 45, 46.

First and second conduits remove oxygen streams having the same purity or very similar purities from the low pressure columns of the first and second units. The streams are mixed without any expansion (optionally valve expansion may be used) or compression and then cooled as single stream 29 in exchanger 11. Nitrogen streams of the same or similar purities may be removed from the medium or low pressure columns of the units 41,42, mixed and sent to the exchanger as a single product stream.

The plant 1 in FIG. 3 allows the problems presented at the start of the invention to be solved in a similar way to the plant 1 in FIG. 1.

In a similar way to the plant 1 in FIG. 1, the plant 1 in FIG. 3 also allows the problems presented at the start of the description to be solved.

Furthermore, the difference in capacity of the double columns 41 and 42 makes it possible to produce oxygen gas OG, and where appropriate medium-pressure nitrogen drawn from the head of the columns 43 and 44, with greater flexibility in terms of throughput.

In the plant 1 in FIG. 3, fluid manifolds (not shown) are arranged at the inlet and at the outlet of the heat-exchange line 11, so that all the heat exchanger bodies (not shown) which the line 11 contains are common for the double columns 41 and 42.

In a variant which has not been represented, these fluid manifolds are absent, some of the exchange bodies of the heat-exchange line 11 being assigned to the double column 41, and the rest of the exchanger bodies of the line 11 being assigned to the double column 42, all the exchanger bodies being surrounded by the thermal insulation wall 15 which is common to them.

Figure 4:
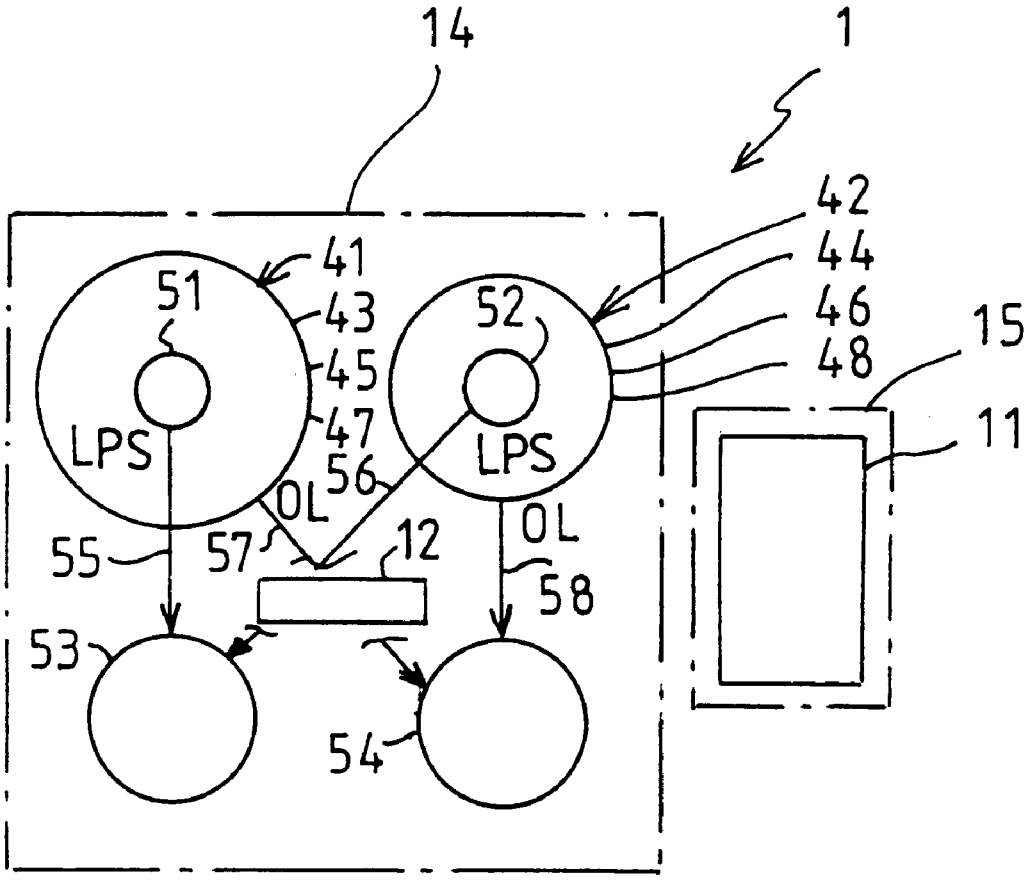
FIG. 4 is a schematic plan view of an alternative of the embodiment in FIG. 3.

FIG. 4 is a plan view schematically illustrating a variant of the plant 1 in FIG. 3, which differs from the latter by the presence of minarets 51 and 52 lying on top of each of the low-pressure columns 45 and 46, and by the presence of a common reservoir 53 for storing liquid nitrogen at low pressure and a common reservoir 54 for storing liquid oxygen at low pressure.

Via a conduit 55, 56, the reservoir 53 receives ULL liquid which is sent from each medium-pressure column 43, 44 to the "minaret" 51, 52 and has its pressure reduced.

Via a conduit 57, 58, the reservoir 54 receives liquid oxygen drawn off from the base of each low-pressure column 43, 44.

The columns 41, 42, 51 and 52, the reservoirs 53 and 54, and the auxiliary heat-exchange line 12 are arranged compactly within the wall 14 which has a substantially cylindrical shape with a vertical axis and a square or rectangular base. To this end, in plan view, the double columns occupy adjacent corners of the common wall 14, the reservoirs 53 and 54 occupy the other two corners, and the exchange line 12 lies in the central region of the square or rectangle.

In a variant which has not been represented, the vaporiser/condensers 45, 46 are of different structures, one being for example a liquid-oxygen bath vaporiser/condenser and the other a liquid-oxygen trickle vaporiser/condenser.

As will be understood, the invention applies more generally to all cryogenic distillation units in parallel taking part in the distillation of air, and the common thermal insulation wall may contain equipment other than those of the plants described by way of example.

The common thermal insulation wall may thus surround distillation columns taking part in the production of argon, which may or may not be arranged in parallel and/or divided into several sections. The first and second columns may alternatively be mixing columns or intermediate columns of triple column systems or single columns.

In all cases, the arrangement of the various elements of the plant within the main wall 14 is chosen so as to minimize the head losses in the connecting conduits.

Key to Figures

FIG. 1

LPS=ULL

NG=NG

LPI=LLL

NR=RN

OG=OG

OL=LO

LR=RL

NL=LN

AIR=AIR

FIG. 2

As FIG. 1

FIG. 3

As FIG. 1+LP=LL

FIG. 4

As FIG. 1

What is claimed is:

1. Air distillation plant comprising a plurality of cryogenic distillation units and thermal insulation means for insulating the distillation units; an air feed conduit for supplying air to at least one distillation unit; the thermal insulation means comprising a common thermal insulation wall surrounding at least first and second distillation units; the first and second distillation units comprising low-pressure columns; first and second conduits for removing a product stream from the first and second distillation units respectively; means for forming a single product stream from the streams in the first and second conduits, wherein there are no expansion means producing external work or compressors provided in the first and second conduits; at least one medium-pressure column connected to the air feed conduit and equipped with a head vaporizer/condenser; the low-pressure columns being connected in parallel to the vaporizer/condenser; the common thermal insulation wall also surrounding the medium pressure column and the vaporizer/condenser.

2. Plant according to claim 1, wherein at least two distillation units are connected to the air feed conduit via pre-treatment means for pre-treating the air to be distilled; said pre-treatment means comprising at least one common pre-treatment unit to which at least two of the distillation units are connected in parallel.

3. Plant according to claim 2, wherein at least one common pre-treatment unit is an air purification device.

4. Plant according to claim 2, wherein at least one common pre-treatment unit is a heat-exchange line for cooling the air to be distilled.

5. Plant according to claim 1, wherein the first and second distillation units comprise double distillation columns, each having a medium-pressure column, a low-pressure column and a vaporizer/condenser providing a heat exchange link between these two columns.

6. Plant according to claim 1, further comprising storage means for storing at least one liquid fraction produced by a cryogenic distillation unit surrounded by the thermal insulation wall; said storage means also being surrounded by the common thermal insulation wall.

7. Plant according to claim 6, wherein the storage means comprise at least one common reservoir for storing a liquid fraction produced by the distillation units to which reservoir the first and second of the first cryogenic distillation units are connected in parallel.

8. Plant according to claim 1, wherein the first and second distillation units have different capacities.

9. Plant according to claim 1, wherein the first and second units comprise at least two medium-pressure columns, two low-pressure columns and two vaporizer/condensers which each provide a heat-exchange link between a medium-pressure column and a low-pressure column, and the vaporizer/condensers are of different structures.

10. Plant according to claim 9, wherein at least the first and second distillation units are arranged side by side of one another.

11. Plant according to claim 1, wherein an expansion valve is provided in one of the first and second conduits.

12. Plant according to claim 1, wherein the points of withdrawal of the streams in the first and second conduits are where the streams have the same principal component, such that the difference in the percentage represented by the principal component in the two streams does not exceed 25.

13. Plant according to claim 12, wherein the difference between the percentage represented by the principal component in the two streams does not exceed 1%.

14. Plant according to claim 1, wherein the product stream is oxygen, nitrogen or argon.

15. Plant according to claim 1, wherein the first and second units are fed only by streams which are fed to both units.

16. Plant according to claim 1, wherein the first and second units are fed only by pairs of streams having the same principal component, one of which is sent to each unit and containing a percentage of that component differing by at most 2%.

17. Plant according to claim 1, wherein air is fed to the first and second columns.

18. Air distillation plant comprising a plurality of cryogenic distillation units and thermal insulation means for insulating the distillation units; an air feed conduit for supplying air to at least one distillation unit; the thermal insulation means comprising a common thermal insulation wall surrounding at least first and second distillation units; the first and second distillation units comprising columns provided with internal packing of different structure and/or densities and/or liquid distributors of different structures; first and second conduits for removing a product stream from the first and second distillation units respectively; means for forming a single product stream from the streams in the first and second conduits, wherein there are no expansion means producing external work or compressors provided in the first and second conduits.

19. Plant according to claim 18, wherein at least two distillation units are connected to the air feed conduit via pre-treatment means for pre-treating the air to be distilled; said pre-treatment means comprising at least one common pre-treatment unit to which at least two of the distillation units are connected in parallel.

20. Plant according to claim 19, wherein at least one common pre-treatment unit is an air purification device.

21. Plant according to claim 19, wherein at least one common pre-treatment unit is a heat-exchange line for cooling the air to be distilled.

22. Plant according to claim 18, wherein the first and second distillation units comprise double distillation columns, each having a medium-pressure column, a low-pressure column and a vaporizer/condenser providing a heat exchange link between these two columns.

23. Plant according to claim 18, further comprising storage means for storing at least one liquid fraction produced by a cryogenic distillation unit surrounded by the thermal insulation wall; said storage means also being surrounded by the common thermal insulation wall.

24. Plant according to claim 23, wherein the storage means comprise at least one common reservoir for storing a liquid fraction produced by the distillation units to which reservoir the first and second of the first cryogenic distillation units are connected in parallel.

25. Plant according to claim 18, wherein the first and second distillation units have different capacities.

26. Plant according to claim 18, wherein the first and second units comprise at least two medium-pressure columns, two low-pressure columns and two vaporizer/condensers which each provide a heat-exchange link between a medium-pressure column and a low-pressure column, and the vaporizer/condensers are of different structures.

27. Plant according to claim 18, wherein at least the first and second distillation units are arranged side by side of one another.

28. Plant according to claim 18, wherein an expansion valve is provided in one of the first and second conduits.

29. Plant according to claim 18, wherein the points of withdrawal of the streams in the first and second conduits are where the streams have the same principal component, such that the difference in the percentage represented by the principal component in the two streams does not exceed 25.

30. Plant according to claim 29, wherein the difference between the percentage represented by the principal component in the two streams does not exceed 1%.

31. Plant according to claim 18, wherein the product stream is oxygen, nitrogen or argon.

32. Plant according to claim 18, wherein the first and second units are fed only by streams which are fed to both units.

33. Plant according to claim 18, wherein the first and second units are fed only by pairs of streams having the same principal component, one of which is sent to each unit and containing a percentage of that component differing by at most 2%.

34. Plant according to claim 18, wherein air is fed to the first and second columns.

35. Air distillation plant comprising a plurality of cryogenic distillation units and thermal insulation means for insulating the distillation units; an air feed conduit for supplying air to at least one distillation unit; the thermal insulation means comprising a common thermal insulation wall surrounding at least first and second distillation units; the first and second distillation units comprising argon columns fed by an argon containing stream removed from a double column, mixing columns fed by a stream from a low pressure column of a double column or from intermediate pressure columns of a triple column or single columns; first and second conduits for removing a product stream from the first and second distillation units respectively; means for forming a single product stream from the streams in the first and second conduits, wherein there are no expansion means producing external work or compressors provided in the first and second conduits.

36. Air distillation plant comprising a plurality of cryogenic distillation units and thermal insulation means for insulating the distillation units; an air feed conduit for supplying air to at least one distillation unit; the thermal insulation means comprising a common thermal insulation wall surrounding at least first and second distillation units; the first and second distillation units comprising first and second columns; first and second conduits for removing a product stream from the first and second distillation units respectively; means for forming a single product stream from the streams in the first and second conduits, wherein there are no expansion means producing external work or compressors provided in the first and second conduits, and at least one fluid derived from air and not air is fed to the first and/or second column.

37. Air distillation plant comprising a plurality of cryogenic distillation units and thermal insulation means for insulating the distillation units; an air feed conduit for supplying air to at least one distillation unit; the thermal insulation means comprising a first common thermal insulation wall surrounding at least first and second distillation units; each distillation unit being connected to at least one heat exchanger body; said heat exchanger bodies being surrounded by a second common thermal insulation wall; first and second conduits for removing a product stream from the first and second distillation units respectively; means for forming a single product stream from the streams in the first and second conduits, wherein there are no expansion means producing external work or compressors provided in the first and second conduits.

* * * * *